US005293646A

United States Patent [19]

Winston

[11] Patent Number: 5,293,646

[45] Date of Patent: Mar. 15, 1994

[54] PROTECTIVE GARMENT

[76] Inventor: Paul Winston, 26 Dunellan Rd., Scarsdale, N.Y. 10583

[21] Appl. No.: 946,526

[22] Filed: Sep. 16, 1992

[51] Int. Cl.[5] ..... A41D 3/08

[52] U.S. Cl. ..... 2/88; 2/84; 2/171; 2/171.1; 2/115; 2/202; 2/207; 2/171.8; 2/174

[58] Field of Search ..... 2/88, 84, 69, 171, 115, 2/171.1, 171.8, 202, 204, 207, 175, 177, 51, 49 R, 243 B

[56] References Cited

U.S. PATENT DOCUMENTS

| | | | |
|---|---|---|---|
| 699,238 | 5/1902 | Reed | 2/49 |
| 1,042,351 | 10/1912 | Johnstone | 2/207 |
| 1,167,058 | 1/1916 | Finberg | 2/84 |
| 2,524,775 | 10/1950 | De Grazia | 2/88 |
| 2,709,261 | 5/1955 | Kalensky | 2/207 |
| 2,767,404 | 10/1956 | Collins | 2/171 |
| 3,084,346 | 4/1963 | Stelter | 2/88 |
| 4,884,298 | 12/1989 | Silas | 2/49 R |
| 4,980,928 | 1/1991 | Ellis | 2/88 |
| 5,048,128 | 9/1991 | Watson, Jr. | 2/177 |
| 5,062,157 | 11/1991 | Muta | 2/171 |
| 5,083,317 | 1/1992 | De Moreta | 2/177 |

*Primary Examiner*—Clifford D. Crowder
*Assistant Examiner*—Gloria Hale
*Attorney, Agent, or Firm*—Lackenbach Siegel Marzullo Aronson & Greenspan

[57] ABSTRACT

A protective garment consists of a planar fabric material section having a central area, inner an outer surfaces, top and bottom opposed ends, first and second opposed sides. A first and second independent elongated strips are partially separated from the remaining fabric and extending correspondingly along the first and second opposed sides from the bottom end in the direction of the top end. Each independent strip has a free end. The planar fabric material section further includes first, second and third securing units. The first securing unit removably secures the free end of the first independent strip to the central area of the fabric during formation of a first sleeve. The second securing means removably secures the free end of the second independent strip to the central area of the fabric during formation of a second sleeve. The third securing unit removably secures positioning of said top end around a head of the wearer.

16 Claims, 5 Drawing Sheets

PROTECTIVE GARMENT

BACKGROUND OF THE INVENTION

This invention generally relates to garments and more specifically to protective garments intended to provide protection for the head, neck, shoulders and back from sun, heat, dirt, and the like. The protective garment can be used during physical labor, exercising, such as swimming, sunning at a beach and during other outdoor recreational endeavors.

Protective garments known from the prior art generally consist of a unitary sheet of material having holes thereon for insertion of the wearer's arms and they are roughly shaped to conform to a human body. Some protective garments in a form of gowns are wrapped around the body, and slots are employed to permit insertion of straps therethrough. However, most such garments are worn so that sides thereof are attached together by straps or the like.

Known types of protective garments are designed to protect either head and neck or shoulders, and/or back as well as other parts of a human body. For example, U.S. Pat. No. 5,062,157 provides a garment which protects only the head and neck of a wearer. U.S. Pat. No. 4,215,434 discloses a gown which could be used for protective purposes. However, this garment does not extend above the shoulders of the user. Such gowns are uncomfortable in use and expensive to manufacture.

The main object of the invention is to provide a protective garment which is light in weight, open to air flow, convenient to use, and inexpensive to manufacture.

BRIEF DESCRIPTION OF THE DRAWINGS

Other advantages and features of the invention are described with reference to exemplary embodiments, which are intended to explain and not to limit the invention, and are illustrated in the drawings in which.

DESCRIPTION OF ILLUSTRATIVE EMBODIMENTS

Specific embodiments of the invention will be described hereinbelow with reference to the drawings. The embodiments shown are by way of example only and merely illustrative of but one of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 1:
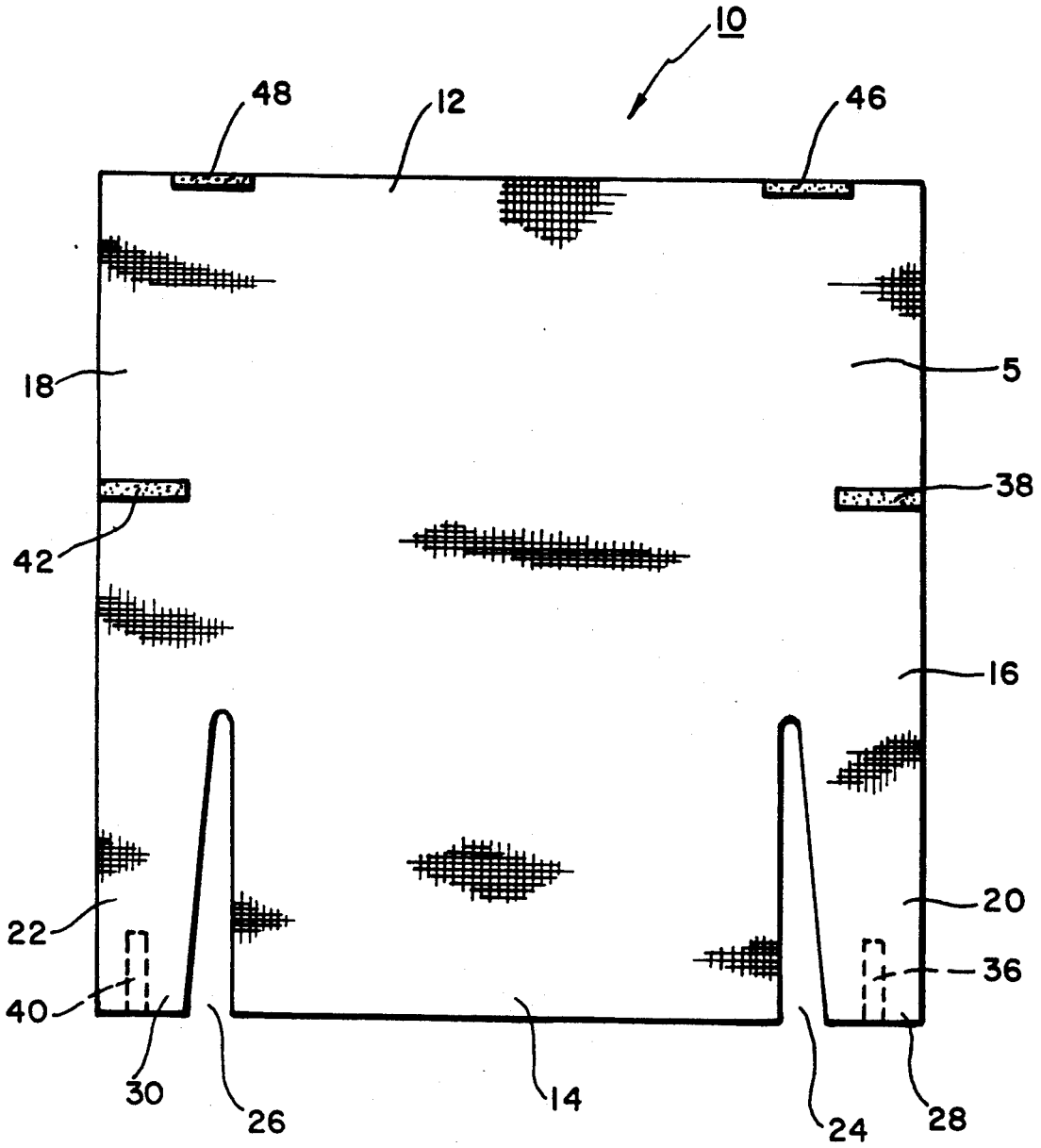
FIG. 1 is a view of an inside surface of a fabric material section according to the present invention.
Figure 2:
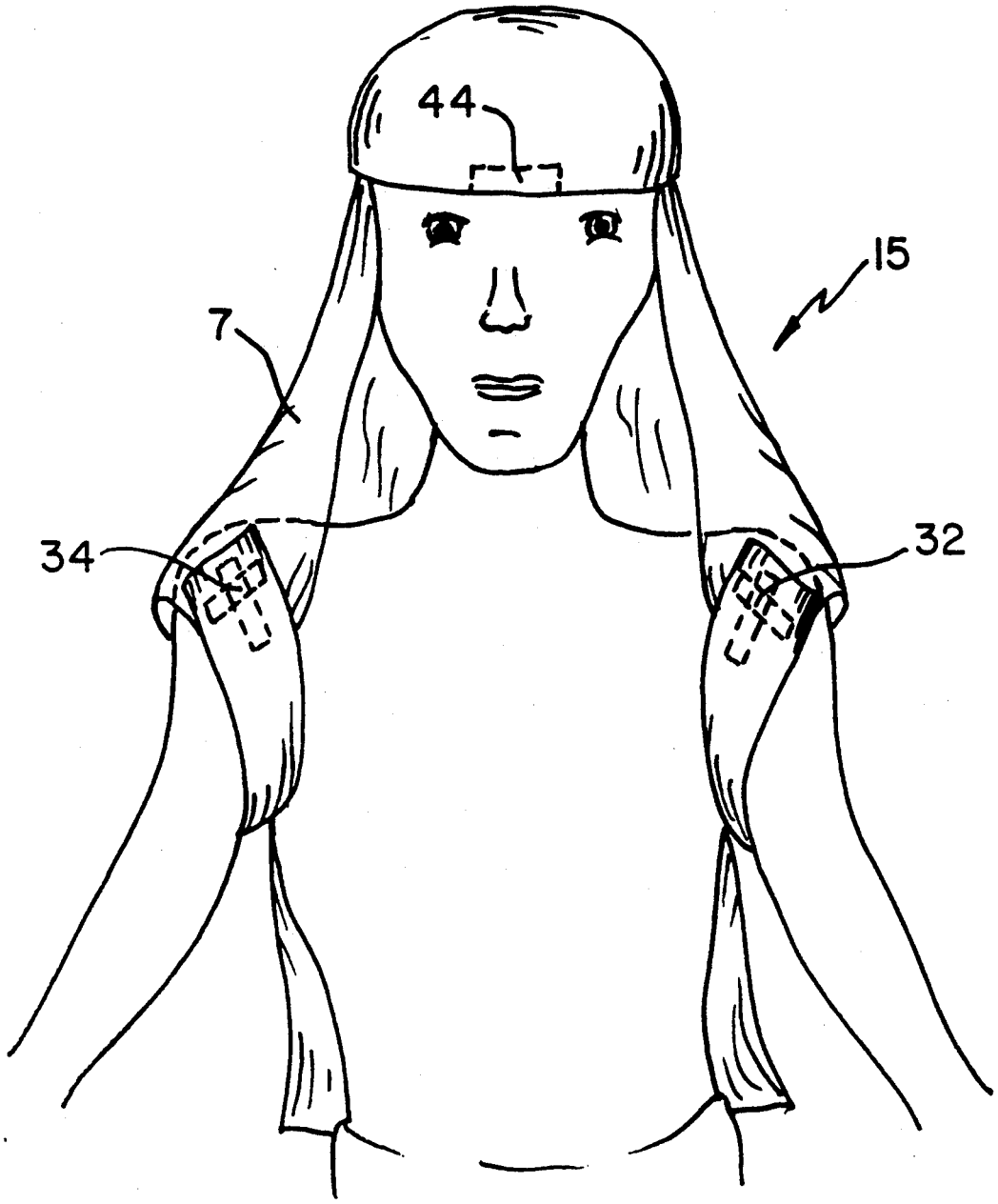
FIG. 2 shows a protective garment according to a first embodiment of the invention.

FIGS. 1 and 2 illustrate a protective garment 15 consisting of a planar fabric material section 10 having top 12 and bottom 14 opposed ends as well as first 16 and second 18 opposed sides. There is an inside surface 5 and an outside surface 7 in the material sections. Two independent elongated strips 20 and 22 are partially separated from the remaining fabric and extend along the first and second opposed sides from the bottom end 14 in the direction of the top end 12. FIG. 1 shows that cutout sections 24 and 26 have an elongated configuration tapering toward the top end 12. However, it should be noted that any reasonable configuration of such cutout sections is within the scope of the invention.

Each independent strip has a free end (28, 30) which is formed by at least a portion of the bottom end 14 and the corresponding side of the fabric material section. The strips should be long enough to extend around the shoulders of the wearer and should have some additional length to provide for an overlap to accommodate the fastener units.

The top and bottom ends of the planar fabric material section should be long enough to extend over the wearer's back to provide coverage for the neck, back and shoulder areas. On the other hand, the length of the top end 12 should be short enough to provide a snug fit when it is placed upon the wearer's forehead.

The protective garment of the invention is intended to be held in place by any suitable type of fasteners attached to the planar fabric material section 10. Such fasteners may be comprised of pairs of button and buttonholes, a snap and corresponding receptacle, a hook and eye unit, etc. However, in the illustrative embodiment, the fasteners are releasably cooperating and complementing sections, more better known as hook and loop fasteners made from a material known as VELCRO®, a registered U.S. trademark of the Velcro Corporation of America.

First fastener unit or fastener means 32 (see FIG. 2) is formed by a pair of matching VELCRO® (hook and loop) strips 36 and 38. The strip 36 is positioned on the outside surface of the free end 28 of the independent strip 20. The strip 38 is situated on the inside surface of a central part of the fabric material section near the first side 16. FIG. 1 illustrates the elongated fastener strip 36 extending longitudinally along the outer surface 7 on the fabric material section and the strip 38 is transversely attached to the inner surface.

The second fastener unit 34 (see FIG. 2) is formed by a pair of VELCRO® (hook and loop) strips 40 and 42 situated symmetrically to the first pair of fasteners. Configuration and positioning of the second pair of fasteners is similar to that of the first pair near the second side 18. Any reasonable configuration of the VELCRO® (hook and loop) strips, as well as their location on either the inside or outside surfaces of the fabric material section, are within the scope of the present invention.

Third fastener unit or fastener means 44 consists of two matching VELCRO® (hook and loop) strips 46 and 48 situated near the top end 12. FIG. 1 shows the strips 48 and 46 both having substantially elongated configurations are positioned on the inner surface of the fabric material section. Nevertheless, any suitable configuration of the strips and their positioning on the fabric material section is a part of the invention.

The use and application of the protective garment 15 will now be described with reference to FIG. 2. Initially, the fabric material section 12 is positioned behind the wearer with the inside surface 15 facing the back of his body. An upper portion of the fabric is placed over the head in such a manner that the top end 12 is positioned on the forehead. Subsequently, the top end 12 of the fabric ,material is wrapped around the head so that the strips 46 and 48 form the third fastener unit 44 and are positioned at the back of the head so as to secure the garment 15 to the user. The top portion of the fabric should be pulled tightly around the head and strips 46 and 48 engage to provide a snug fit of the garment upon the wearer's forehead. At the same time, the remaining fabric hangs or drapes freely along the wearer's body.

To form a first sleeve, a free end 28 of the first independent strip is wrapped around the nearest shoulder to place the strips 36 and 38 of the first fastener unit 32 into engagement. The second sleeve is made in a similar fashion when the second elongated strip is wrapped around another shoulder so that the fastener strips 40 and 42 are brought together to secure the proper configuration and positioning of the sleeve. As a result, the protective garment is properly placed on the wearer's body covering the head, neck, shoulders and back.

Figure 3:
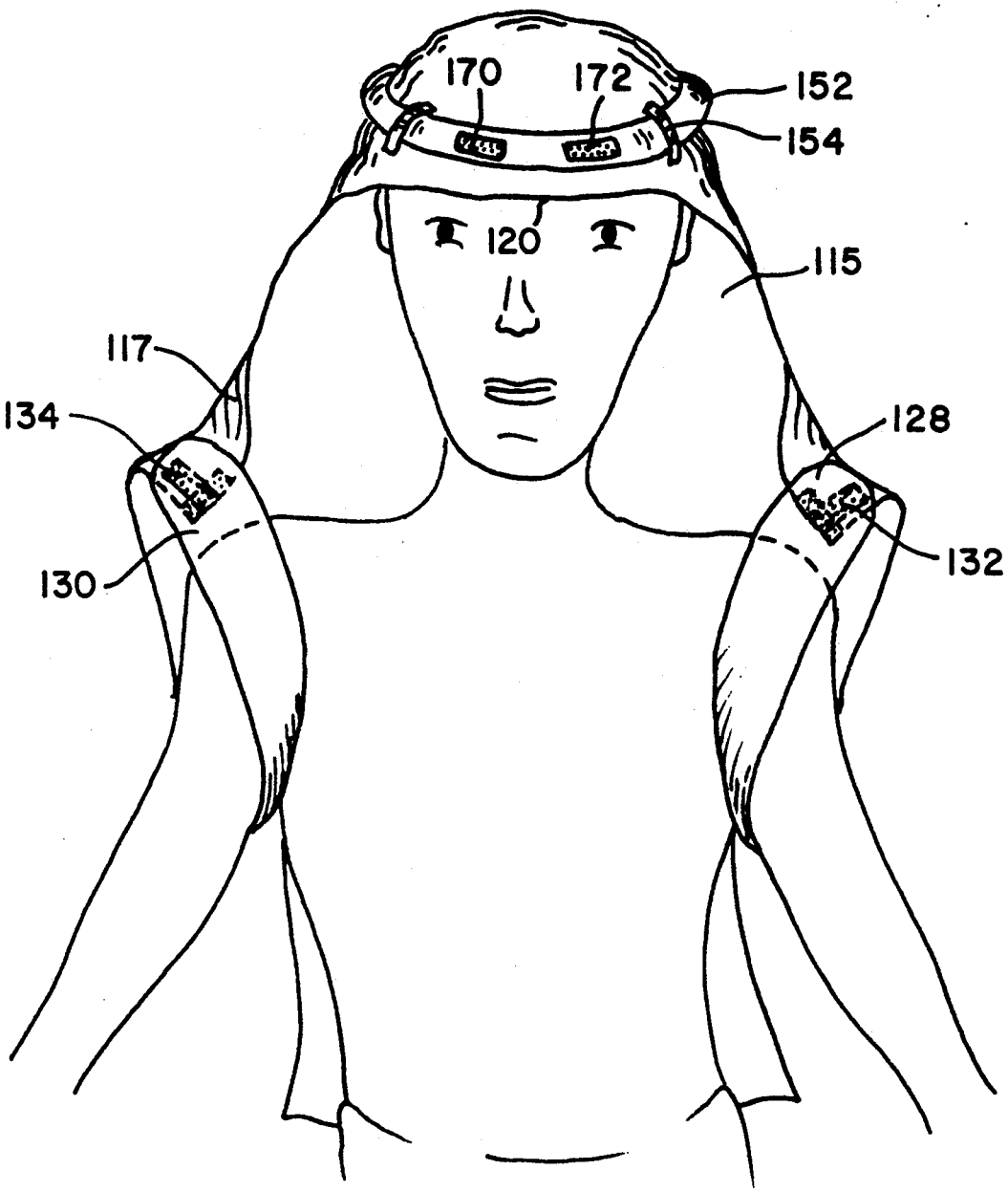
FIG. 3 shows a protective garment according to the second embodiment of the invention.
Figure 4:
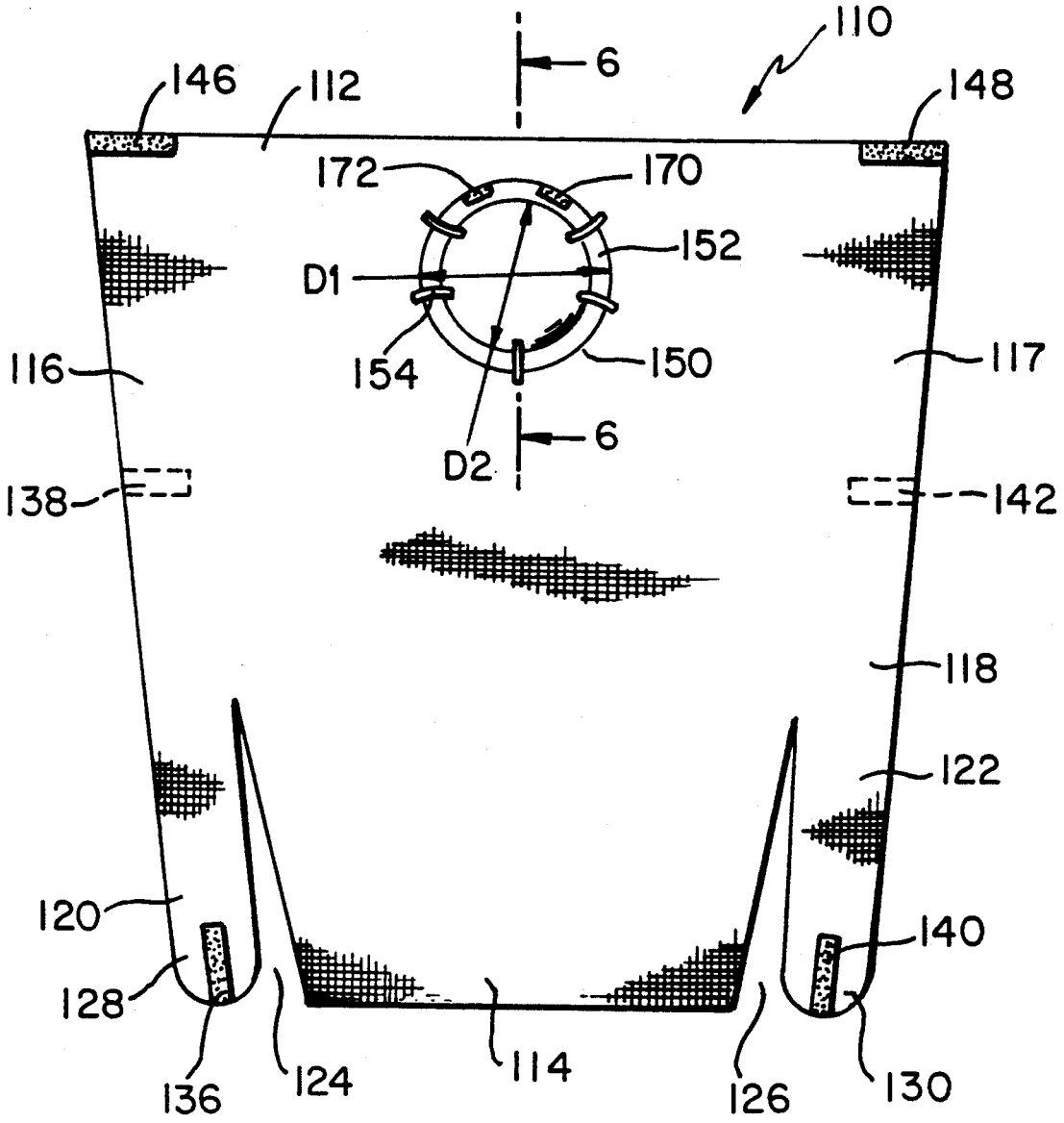
FIG. 4 is a view of an outside surface of a fabric material section according to the second embodiment of the invention.

Another embodiment of the present invention is illustrated in FIGS. 3–6. A fabric material section 110 of this embodiment is provided with inside surface 115 and outside surface 117. FIG. 4 shows that in the material section, there are top 112 and bottom 114 opposed ends as well as first 116 and second 118 tapering opposed sides. Independent elongated strips 120 and 122 extending along the first and second opposed sides are partially separated from the remaining fabric. The first and second independent strips are provided with free ends 128, 130 correspondingly. In FIG. 4, these free ends are shown to have a rounded configuration. However, any design thereof, such as trapezoidal, rectangular, etc., are within the scope of the invention.

The independent elongated strips are partially separated from the remaining fabric by cutout sections 124 and 126 and extend along the first and second opposed sides from the bottom end 114 toward the top end 112. In the fabric material section 110 shown in FIG. 4, each cutout section is formed by two sides interposed to each other at an acute angle. The points of these angles are located near the central part of the material section.

The fabric material section 110 is provided with three fastener units or fastener means. The first fastener unit 132 (see FIG. 3) is formed by matching VELCRO® (hook and loop) strips 136 and 138. The strip 136 positioned on the outer portion 117 at the free end 128 and is adopted for engagement with the strip 138 situated at the inner portion of the central part of the fabric material section.

The second fastener unit 134 (see FIG. 3) which is identical to the first fastener unit 132 consists of two strips hook and loop of VELCRO® material 140 and 142. The design and location of the fastener units 132 and 134 are similar to the fastener units of the first embodiment.

Although VELCRO®-type hook and loop fastener arrangements are described with reference to the second embodiment, any conventional type of fasteners is a part of the present application.

An elastic unit or securing means 150 is positioned on the outer surface 117 of the fabric material section in the vicinity of the top end 112. This securing means is typically made of a closed elastic-containing strip. For example, FIGS. 3–6 show the elastic-containing strip 152 having a substantially circular configuration with an outside diameter D1 and inside diameter D2.

The elastic-containing strip 152 can be attached to the fabric material section by suitable means such as stitching, etc . In this respect, FIGS. 3–6 show that the elastic-containing strip is connected to the fabric by a plurality of members 154 circumferentially distributed along its periphery and having their ends attached to the outer surface 117. In use, the elastic unit 150 secures position of the top end of the fabric around the head of the wearer allowing the remaining fabric material to cover the head, neck, back and shoulders.

Formation of the garment in the second embodiment is in some way identical to that of the first embodiment of the invention. After the top portion of the fabric is properly positioned on the head of the wearer, the elastic-containing strip 152 fits tightly on the head to provide a snug fit of the garment on the forehead. Then, the first independent strip 128 is wrapped around an upper part of a corresponding arm and a shoulder so that strips 136 and 148 are engaged, thus forming a first sleeve. The second sleeve is similarly formed when the second elongated strip 130 is wrapped around an upper part of another arm and a corresponding shoulder, so that the fasteners 140 and 142 secure the proper configuration and positioning of the second sleeve.

Figure 6:
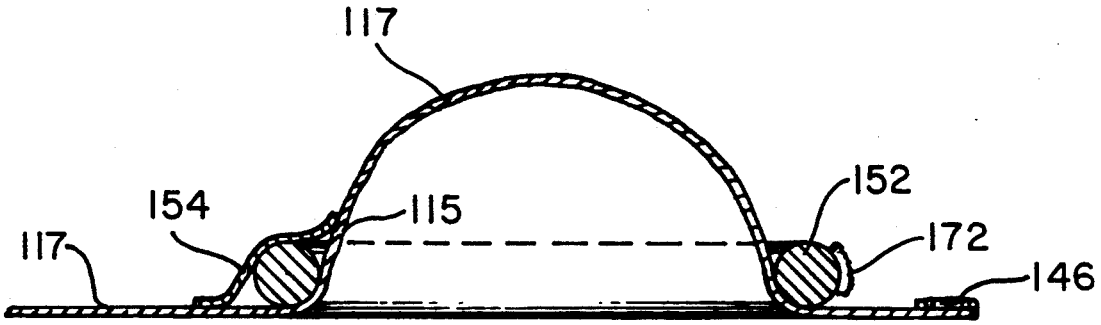
FIG. 6 is a cross-sectional view according to sectional line 6—6 in FIG. 4.
Figure 5:
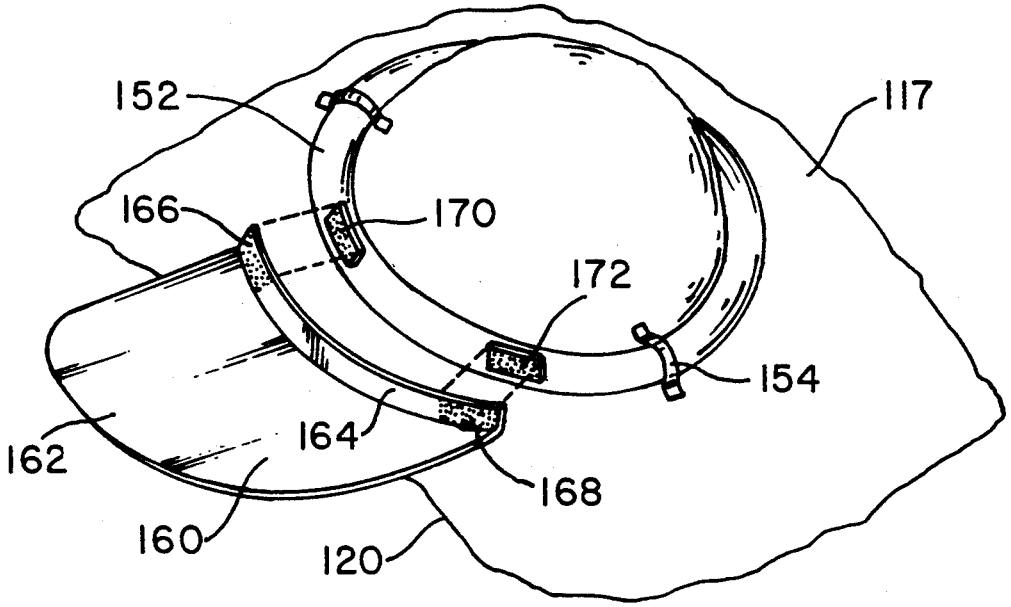
FIG. 5 is partial view showing the second embodiment of the protective garment having a visor.

A removable visor can be used in combination with the second embodiment of the invention. As best illustrated in FIG. 6, a visor 160 has a flat, substantially horizontal part 162 and a relatively narrow and vertical part 164. The visor 160 is removably attached to the elastic-containing strip 152 by means of two pairs of VELCRO® hook and loop strips. VELCRO® hook and loop strips 168 and 166 are situated at the ends of, the vertical part 164. Two other matching VELCRO® hook and loop strips 170 and 172 are positioned on the front part of the elastic-containing strip 152. In order to attach the visor 160 to the protective garment of the invention (as illustrated in FIG. 6), the VELCRO® hook and loop strips of the vertical part of the visor are placed into engagement with the VELCRO® hook and loop strips of the front part of the elastic-containing strip.

The use of the VELCRO® (hook and loop) securing arrangement substantially enhances the versatility of the present invention. For example, FIG. 3 illustrates that the second embodiment of the protective garment can be used without the visor. The VELCRO® (hook and loop) securing arrangement described hereinabove is one of many ways of attaching the visor to the protective garment which constitutes an optional part of the invention.

A material which forms the protective garment of the invention should be comfortable when placed against the skin as the garment will be worn frequently during the summer time. The material should be relatively low cost and have high durability, so that its shape can be easily maintained through many washings. The garment can be made of suitable cloth material, whether made with natural fibers, synthetic fibers or a mixture thereof. In some instances, a preferred material is cotton, selected for its good absorption of moisture. However, in some instances, the garment could be made of a material which is 50% cotton and 50% polyester blend.

The protective garment may also be of a suitable paper or cellulosic, non-woven fabric material that may be discarded after use. Such paper material should be sturdy enough to absorb moisture. Multi-ply cellulosic material that is soft and pliable can be suitably used for this purpose. While the above-discussed materials have been found to be suitable, it should be recognized that many other forms of materials may be utilized, provided that they have the desired characteristics.

Some of the numerous ways in which the protective garment may be designed and placed on the body have been illustrated and described. From this description it is apparent that variations of design and appearance of the garment on the body may be effected easily, quickly and conveniently.

What is claimed:

1. A protective garment comprising a planar fabric material to protect the head, neck, shoulders and back, said garment including:

a planar fabric material section having a central area, inner and outer surfaces, top and bottom opposed ends, first and second opposed sides wherein said top end consists of an upper straight edge for wrapping and covering the forehead, first and second independent elongated strips extending along said first and second opposed sides for a predetermined distance up from said bottom end in the direction of said top end, each said independent strip being elongated and having a free end, said planar fabric material section further including first, second and third securing means, said first securing means attached adjacent to said first side for removably securing said free end of the first independent strip to the central area of the fabric during formation of a first sleeve, said second securing means attached adjacent to said second side for removably securing said free end of the second independent strip to the central area of the fabric during formation of a second sleeve, said third securing means removably securing said top end around a head of the wearer, said top end being adapted to encircle a forehead so as to snugly fit thereabout by said third securing means and to enable the draping of said planar fabric material to cover at least said head, neck, shoulders and back of a wearer, and wherein said independent elongated strips being wrapped around corresponding shoulders to define said first and second sleeve portions, said second and third securing means removably attaching said free ends of said independent strips to the planar fabric material during formation of said first and second sleeve portions.

2. A protective garment according to claim 1, wherein said third securing means is a hook and loop arrangement.

3. A protective garment according to claim 2, wherein said first and second securing means are hook and loop arrangements.

4. A protective garment according to claim 3, wherein said first securing means consists of two hook and loop strips positioned at said free end of said first independent strip and said central area of the planar fabric material section.

5. A protective garment according to claim 3, wherein,,said second securing means consists of two separated hook and loop strips positioned at said free end of said second independent elongated strip and said central area of the fabric.

6. A protective garment according to claim 3, wherein said third securing means is two hook and loop strips separated from each other and positioned at said top end of the planar fabric material section.

7. A protective garment comprising a planar fabric material to protect the head, neck, shoulders and back, said garment including:

a planar fabric material section for covering the forehead, and having a central area, inner and outer surfaces, top and bottom opposed ends, first and second independent opposed sides, first and second independent strips extending along said first and second opposed sides for a predetermined distance up from said bottom end in the direction of said top end, each said independent strip having a free end, said planar fabric material section further having first and second securing means, said first securing means removably securing said free end of the first independent strip to the central area of the fabric during formation of a first sleeve, said second securing means removably securing said free end of the second independent strip to the central area of the fabric during formation of a second sleeve, and having elastic means securely positioning said top end around the head of a wearer allowing said planar fabric material to cover at least the head, neck, back and shoulders of a wearer, and said first and second independent elongated strips being adapted to be wrapped around corresponding shoulders to define said first and second sleeves.

8. A protective garment according to claim 7, wherein said elastic means is a closed elastic-containing strip having sufficient length to be extended substantially around the head of a wearer.

9. A protective garment according to claim 8, wherein said closed elastic containing strip has a substantially circular configuration.

10. A protective garment according to claim 8, wherein said first and second securing means are hook and loop arrangements.

11. A protective garment according to claim 10, wherein said first securing means consists of two hook and loop strips positioned at said free end of said first independent strip and said central area of the planar fabric material section.

12. A protective garment according to claim 11, wherein, said second securing means consists of two separated hook and loop strips positioned at said free end of said second independent elongated strip and said central area of the planar fabric material section.

13. A protective garment according to claim 8, wherein a visor is removably attached to a front part of said elastic-containing strip.

14. A protective garment according to claim 13, wherein said visor protects the eyes of a wearer when said protective garment is in use.

15. A protective garment according to claim 13, wherein said visor is attached to said elastic-containing strip by a hook and loop securing arrangement.

16. A protective garment as claimed in claim 8, wherein said elastic-containing strip is attached to said outer surface of said planar fabric material section.

* * * * *